United States Patent [19]

Komiyama et al.

[11] 4,236,238

[45] Nov. 25, 1980

[54] ELECTRONIC DIGITAL TIMEPIECE HAVING A STOPWATCH FUNCTION AND A TIMER FUNCTION

[75] Inventors: Katsuhiko Komiyama; Osamu Kamisawa, both of Tanashi, Japan

[73] Assignee: Citizen Watch Company Limited, Tokyo, Japan

[21] Appl. No.: 29,235

[22] Filed: Apr. 11, 1979

[30] Foreign Application Priority Data

Apr. 17, 1978 [JP] Japan ..... 53-44179

[51] Int. Cl.[3] ..... G04F 10/00

[52] U.S. Cl. ..... 368/71; 368/30; 368/84; 368/85; 368/107

[58] Field of Search ..... 58/4 A, 23 R, 39.5, 58/58, 38 R, 38 A, 39.5, 57.5, 74, 152 R, 152 B; 235/92 T, 92 PE

[56] References Cited

U.S. PATENT DOCUMENTS

| | | | |
|---|---|---|---|
| 3,910,362 | 10/1975 | Piquet | 58/74 |
| 3,982,387 | 9/1976 | Tanaka | 58/4 A |
| 4,015,418 | 4/1977 | Rochat | 58/50 R |

FOREIGN PATENT DOCUMENTS

| | | | |
|---|---|---|---|
| 2328233 | 6/1977 | France | 58/39.5 |

*Primary Examiner*—Edith S. Jackmon
*Attorney, Agent, or Firm*—Jordan and Hamburg

[57] ABSTRACT

An electronic digital timepiece having standard timekeeping, stopwatch, and timer functions, and a weekdays display section composed of a plurality of display segments selectively activated to indicate the day of the week in the standard timekeeping display mode, and which are rapidly and sequentially activated in a predetermined direction when operation is performed in a stopwatch mode, and are rapidly and sequentially activated in the opposite direction when operation is performed in the timer mode of operation, to indicate the type of operation mode.

14 Claims, 15 Drawing Figures

| Fig. 4A | Fig. 4B |
|---|---|

| Fig. 5A | Fig. 5B |
|---|---|

STOPWATCH/TIMING COUNTER CIRCUIT 44
DIRECTION INDICATION DISPLAY DECODER 132
WEEKDAYS DISPLAY CHANGEOVER CIRCUIT 86
DOWN COUNTER 48
UP COUNTER 40
COUNTER 134
CK1
CK2
CR TM

DIRECTION INDICATION CHANGEOVER CIRCUIT 188
WEEKDAYS DISPLAY DECODER 93
DISPLAY SELECTION CIRCUIT 64
DOWN COUNTER 48
UP COUNTER 46
COUNTER 186
CK1
CK2
CR
TM

WEEKDAYS DISPLAY DECODER 93
DIRECTION INDICATION DECODER CIRCUIT 192
UP/DOWN COUNTER 122
1/10 SECONDS COUNTER SECTION 191
CK1
CK2
Tk Cr Tm
CR
TM

ELECTRONIC DIGITAL TIMEPIECE HAVING A STOPWATCH FUNCTION AND A TIMER FUNCTION

BACKGROUND OF THE INVENTION

The present invention relates to electronic digital timepieces, and in particular to an electronic digital timepiece having a stopwatch function and a timer function in addition to the standard timekeeping function.

In recent years, a variety of electronic digital timepieces have been developed incorporating various functions. These include electronic digital timepieces having both a stopwatch (sometimes referred to as a chronograph) function and a timer function. When such a timepiece is in the stopwatch mode of operation, then counting up, in units of seconds or tenths of seconds generally, is performed starting from a point in time which is designated by the user actuating an operating member. In the timer mode of operation, counting down is performed, starting from an initial time value which has been preset by the user, is performed. Since these functions are fundamentally similar in nature, although opposite in direction of counting, it is common to utilize the same elements of the timepiece display to indicate the time count during stopwatch and timer operation. In such a timepiece, therefore, it is desirable to provide some means for indicating to the user that the stopwatch or the timer mode of operation has been established. It is also desirable to provide some means for indicating that operation is actually taking place, in the operating mode which has been established, or that operation has been suspended. With conventional electronic timepieces having both stopwatch and timer functions, such indicating means have been provided by additional display elements, driven by additional electronic circuitry, so that the amount of display area required and the degree of circuit complexity are increased.

SUMMARY OF THE INVENTION

With an electronic digital timepiece having stopwatch and timer functions in accordance with the present invention, however, these disadvantages of the conventional timepieces are eliminated. A section of the timepiece display, which is used to indicate the day of the week when the timepiece is in the standard timekeeping mode of operation, is also used to indicate the mode of operation, in the stopwatch and timer modes, and to indicate whether operation in the selected mode is actually taking place. Since the same display elements are used to indicate the day of the week and to indicate either the stopwatch mode of operation or the timer mode, the amount of additional circuitry required to provide these operating mode indications is reduced to a minimum.

It is therefore an object of the present invention to provide an improved electronic timepiece having a standard timekeeping function, a stopwatch function, and a timer function, whereby display elements which serve to provide a weekday indication when the timepiece is in the standard timekeeping mode of operation are also used to indicate whether said stopwatch function or said timer function has been selected.

Further objects, features and advantages of the present invention will be made apparent from the following description, when taken in conjunction with the attached drawings. The scope of the present invention is given by the appended claims.

DESCRIPTION OF THE PREFERRED EMBODIMENTS

Figure 1A:
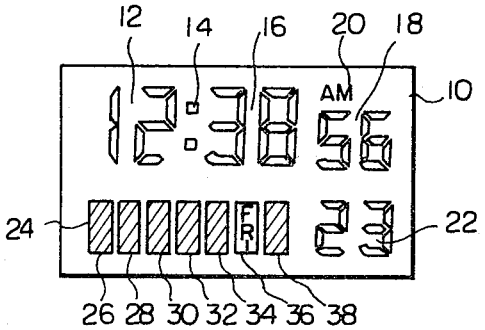
FIG. 1A, FIG. 1B and FIG. 1C show the appearance of the display of an embodiment of an electronic timepiece according to the present invention, in the standard timekeeping, stopwatch, and timer modes of operation respectively.

Referring now to the drawings, FIG. 1 is a plan view of the display of an electronic timepiece according to the present invention. FIG. 1A shows the appearance of the display when the timepiece is in the normal standard timekeeping mode of operating, referred to hereinafter as the timekeeping mode. Display 10, which is of liquid crystal type, comprises a plurality of display segments to provide an hours digits display 12, a minutes digits display 16, which are separated by a colon display 14, a seconds digits display 18, an AM/PM display 20, a date digits display 22, and a weekdays display section 24. Weekdays display section 24 is composed of a set of seven display segments, denoted by numerals 26, 28, 30, 32, 34, 36 and 38, which are used to indicate the days of the week Sunday, Monday, Tuesday, Wednesday, Thursday, Friday and Saturday, respectively. In order to indicate a particular day of the week, the corresponding display segment of 26 to 38 is left unactivated (i.e. with no voltage being applied to the electrodes of that display segment), causing the segment to be invisible or light in color, while the other six display segments are activated (by applying a voltage to the electrodes of these display segments), causing them to be visible, by appearing dark in color relative to the remainder of the display. This enables a set of letters indicating the weekday corresponding to the selected unactivated segment to be made visible. In the example of FIG. 1A, segment 36 is left unactivated, so that the letters FRI, indicating Friday, are visible. This method of indicating the day of the week on an electronic timepiece is already known and utilized. The display of FIG. 1A therefore indicates a time of 12(hours): 38(minutes): 55(seconds): AM: 23(i.e. the 23d of the month): FRI (i.e. Friday).

Figure 1B:
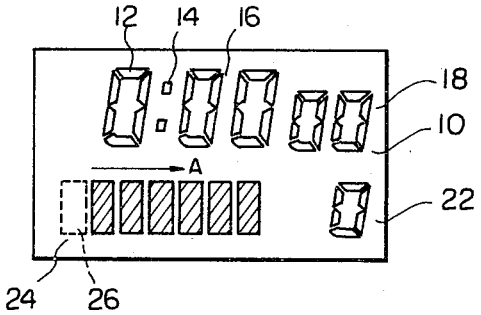

FIG. 1B shows the appearance of display 10 when the timepiece is in the stopwatch mode of operation. FIG. 1B shows the condition in which the time indicated by display 10 has been reset to zero. Display digits 12, 16, and 18 indicate the hours, minutes and seconds counted during stopwatch operation. Date digits 22 are used in the stopwatch mode of operation to indicate tenths of seconds. Date display section 24 is used both to indicate whether stopwatch operation is actually taking place, and to provide discrimination between stopwatch operation and timer operation. When the stopwatch mode of operation has been selected, but before stopwatch operation (i.e. time counting) has actually been initiated, or if stopwatch operation has been suspended, one of display segments 26 to 38 of weekdays display 24 is held in the unactivatedstate, while the other six display segments of weekdays display 24 are held in the activated state. For the display example of FIG. 1B, it is assumed that segment 26 is being held in the unactivated state. If stopwatch operation is now initiated by the timepiece user, in a manner to be described hereinafter, then the time indicated by display digits 12, 16, 18 and 22 will begin to be incremented, at 1/10 second intervals. At the same time, the unactivated segment of weekdays display 24 will be made to appear to repetitively move rapidly from left to right across weekdays display section 24. This is accomplished by deactivating display segment 28 and activating all of the other weekdays display segments, then deactivating display segment 30 and activating all of the other weekdays display segments, and so on. After display segment 38 has been deactivated, then display segment 26 is again deactivated and the cycle is repeated. This movement from left to right in the weekdays display section 24 provides an indication to the user both that the timepiece is in the stopwatch mode of operation, and that stopwatch operation is actually being performed.

Figure 1C:
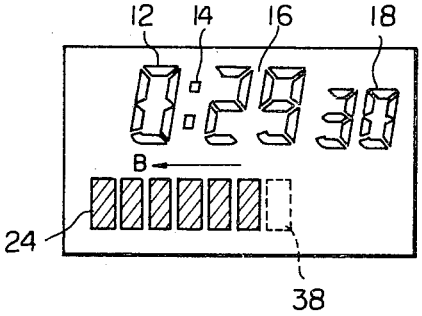

FIG. 1C shows the appearance of display 10 when the timepiece is in the timer mode of operation. In FIG. 1C, a time of 0 hours: 14minutes: 30 seconds has been preset by the user, in a manner to be described hereinafter. As in the timekeeping and stopwatch modes of operation, display digits 12, 14 and 16 of display 10 indicates hours, minutes and seconds of time respectively. Since tenths of seconds are not indicated in the timekeeping mode of this embodiment, the date display digits 22 are not activated. In the condition in which the timer mode of operation has been selected, but timer counting has not yet been inititated, one of display segments 26 to 38 is held in the unactivated state, while the other six display segments of weekday display section 24 are held in the activated state. In the example of FIG. 1C, it is assumed that display segment 38 is in the unactivated state. If timer operation is now initiated by the user, in a manner to be described hereinafter, then the time indicated by display digits 12, 14 and 16 begins to be decremented at one second intervals, i.e. counting down of time is performed. At the same time, the unactivated segment of weekdays display 24 is made to appear to move repetitively and rapidly from right to left across weekdays display section 24. This is accomplished by deactivating display segment 36 and activating all other segments, then deactivating display segment 34 and activating all other segments, and so on. This movement from right to left in the weekdays display 24 provides an indication to the user that the timepiece is in the timer mode of operation, and that timer operation is actually being performed.

Figure 2:
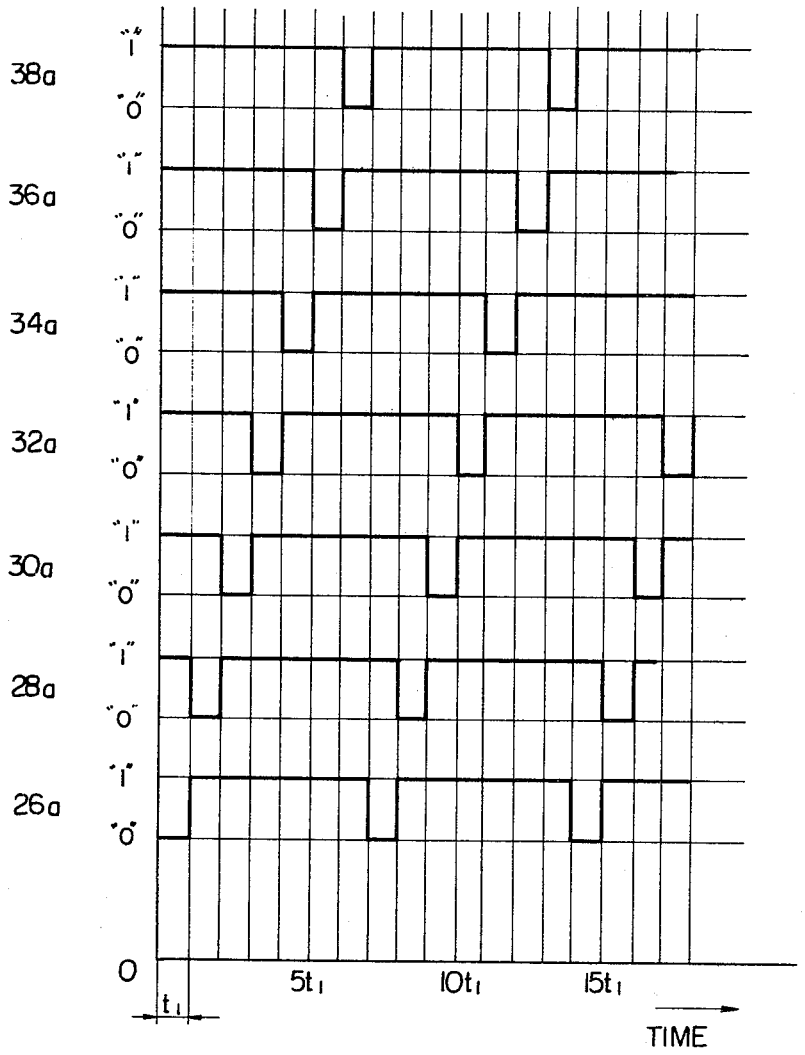
FIG. 2 shows the waveforms of voltages applied to electrodes of a weekdays display section of the embodiment of FIG. 1A to 1C, when the timepiece is in the stopwatch mode of operation.

FIG. 2 illustrates the waveforms of the voltages applied between the liquid crystal display cell electrodes of each of display segments 26 to 38 of weekdays display section 24, when the timepiece is in the stopwatch mode of operation. Voltages **26*a*, 28*a*, 30*a*, 32*a*, 34*a*, 36*a*, and 38*a* are applied to display segments 26, 28, 30, 32, 34, 36 and 38 respectively. Before stopwatch operation is actually inititated, the voltage applied to the electrodes of segment 26 is at the logical "0" level, while the voltages applied to the other display segment electrodes 28 to 38 are at the logic "1" level. At time 0, stopwatch operation is initiated by the user, and after a time interval $t_1$, the voltage 26*a* goes to the "1" logic level, while the voltage 28*a* goes to the "0" logic level. After another interval $t_1$, voltage 28*a* goes to the "1" logic level, and voltage 30*a* goes to the "0" level. In this way, each of display segments 26, 28, 30, 32, 34, 36 and 38 is sequentially deactivated. When the voltage 38*a*** returns to the "1" logic level, the cylce is again repeated, and so on. In the embodiment of the present invention described herein, time $t_1$ is 1/10 second.

Figure 3:
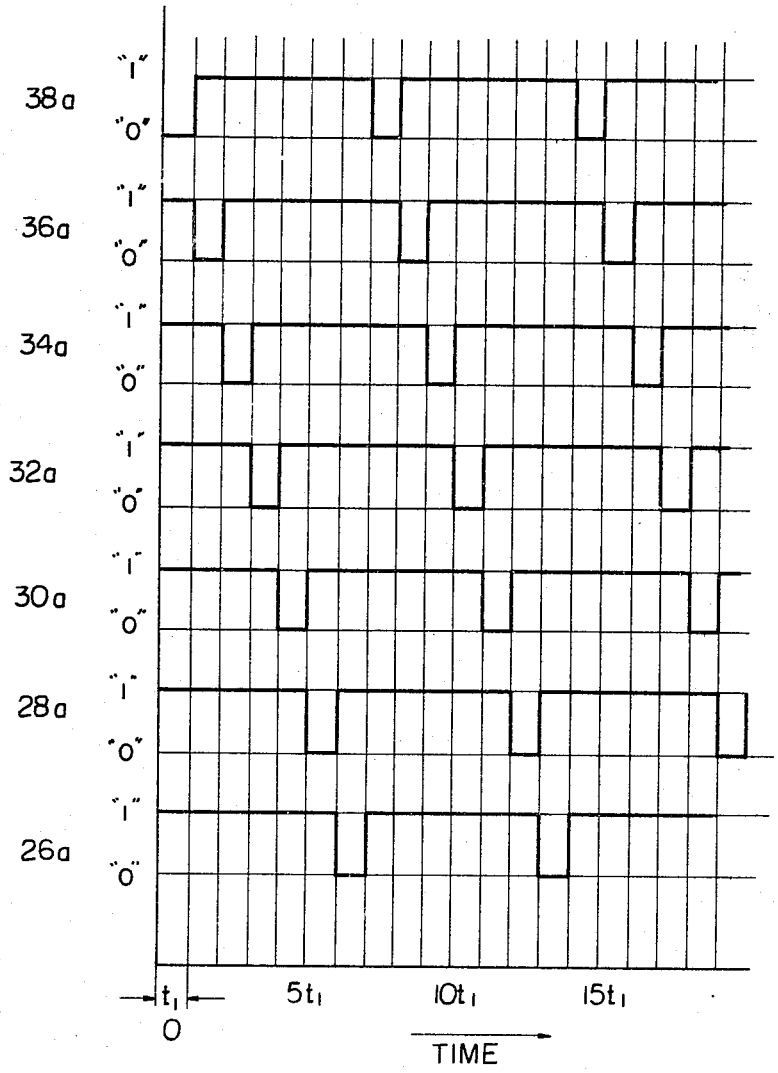
FIG. 3 shows the waveforms of voltages applied to electrodes of the weekdays display section when the timepiece is in the timer mode of operation.

FIG. 3 shows the voltages applied between the cell electrodes of display segments 26 to 38 of weekdays display 24, when the timer mode of operation is initiated. At time 0, when timer operation is actually initiated, the voltage across the electrodes of display segment **38*a* is at the "0" logic level, while the voltage across the electrodes of the other display electrodes 26 to 36 is at the "1" level. After time interval $t_1$, the voltage across the electrodes of display segment 38 goes to the "1" logic level, and the voltage across the electrodes of segment 36*a* goes to the "0" logic level, and so on. In this way, each of display segments 38 to 26 is sequentially deactivated. When the segment 26** has again been activated, the cycle is repeated, and so on repetitively.

Figures 4, 4A:
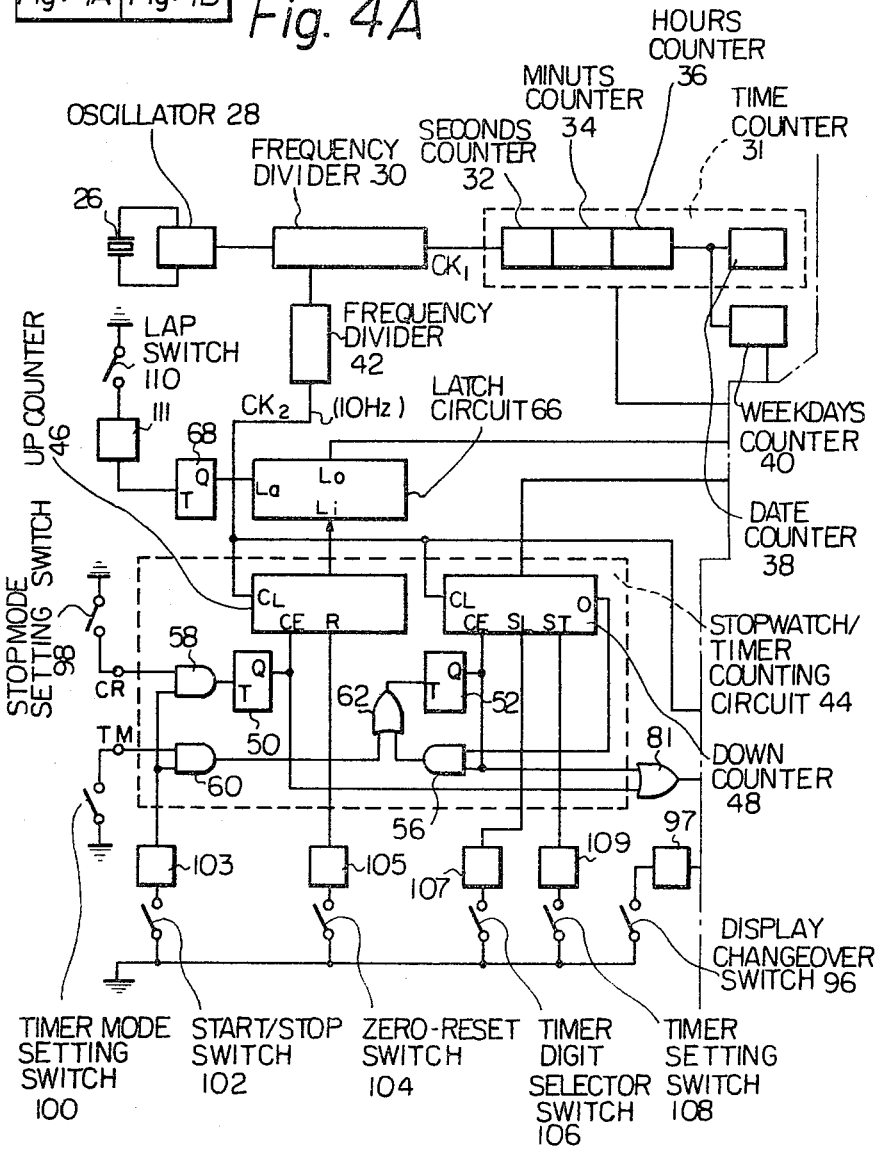
FIG. 4 is a block diagram showing the relationship between FIGS. 4A and 4B.
FIGS. 4A and 4B are each part of a first example of a circuit diagram for an electronic timepiece according to the present invention.
Figure 4B:
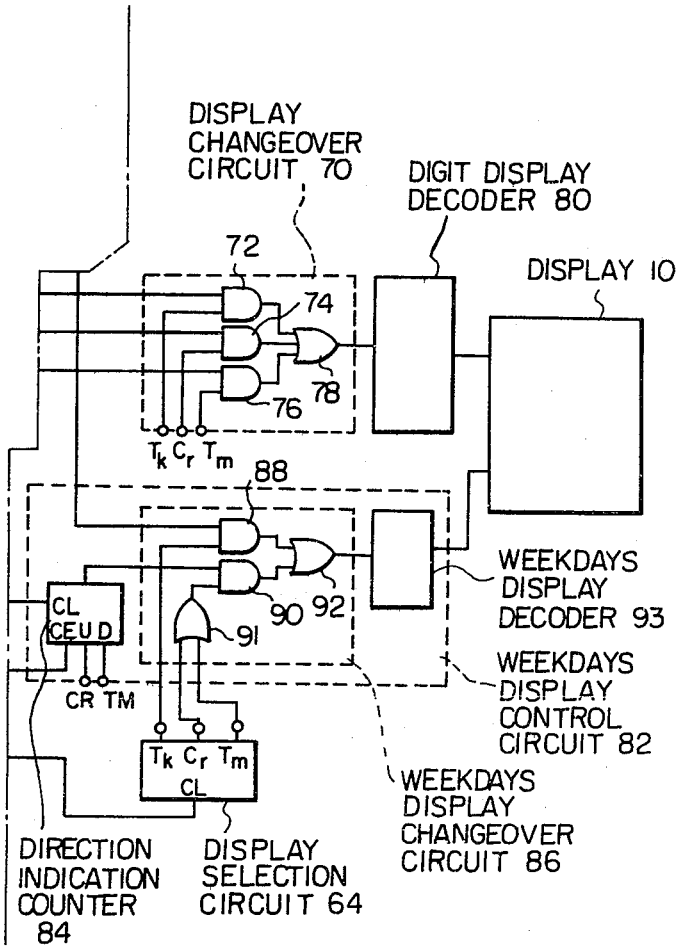

Referring now to FIGS. 4, 4A and 4B a first example of a circuit diagram for an electronic timepiece in accordance with the present invention is shown. Reference numeral 28 denotes an oscillator circuit, which produces a standard frequency signal, the frequency of which is determined by a quartz crystal vibrator 26. The standard frequency signal is applied to a frequency divider circuit 30, which produces an output signal CK2 having a frequency of 1 Hz, constituting a unit time signal. Unit time signal CK1 is applied to a time counter circuit 31. Time counter circuit 31 comprises a seconds counter 32, which receives signal CK1, a minutes counter circuit 34 which receives the output signal from seconds counter 32, and an hours counter 36 which receives the output signal from minutes counter 34. The output signal from hours counter 36, which has a period of 24 hours, is applied to inputs of a date counter 38 and a weekdays counter 40. For simplicity of description, the circuit means for providing an AM/PM indication are omitted from FIGS. 4, 4A and 4B. For the same reason, the means by which date information from date counter 38 is applied to display decoder 80, and by which changeover between date display and 1/10 seconds digits display are implemented, are also omitted.

A high frequency output signal from frequency divider circuit 30 is applied to a frequency divider circuit 42, which produces an output signal CK2 having a frequency of 10Hz. Signal CK2 is applied to a stopwatch/counter timing circuit 44, which includes an up counter circuit 46 and a down counter circuit 48. Signal CK2 is applied to the clock input terminals of counter circuits 46 and 48. The Q output of a toggle-type flip-flop 50 is connected to the Count Enable (CE) control terminal of counter 46, and also to an input of an OR gate 81. The T (toggle) input terminal of flip-flop (referred to hereinafter as FF) 50 is connected to the output of an AND gate 58. One input of AND gate 58 is coupled to a switch 98, designated as a stopwatch mode setting switch. Since the positive terminal of the battery of the timepiece is connected to ground, i.e. to the timepiece body, actuation of switch 98 to the ON state results in a "1" level input being applied from the switch to the corresponding input of AND gate 58. The other input of AND gate 58 is connected to the output of a waveshaping circuit 103, which is coupled to a start/-stop switch or counter control switch 102. Each time start/stop switch 102 is actuated, a single "1" level pulse is applied from waveshaping circuit 103 to the corresponding input of AND gate 58. The output of waveshaping circuit 103 is also coupled to an input of an AND gate 60. The other input of AND gate 60 is connected to a timer mode setting switch 100. The output of AND gate 60 is applied to an input of an OR gate 62, the output of which is connected to the T input of a toggle-type flip-flop 52. The Q output of FF 52 is applied to the Count Enable (CE) terminal of down counter 48, and also to an input of an AND gate 56. The Q output of FF 52 is also applied to the other input of OR gate 81. The "0" output terminal of down counter 48 is connected to the other input of AND gate 56. This "0" output terminal goes to the "1" logic level when down counter 48 has counted down to zero. The output of AND gate 56 is applied to the other input of OR gate 62.

The R (reset) terminal of up counter 46 is connected to the output of a waveshaping circuit 105, which is coupled to a zero reset switch 104.

A terminal SL (selector) of down counter 48 is connected to the output of a waveshaping circuit 107, which is coupled to a timer digit selector switch 106. Down counter 48 is of a form in which information corresponding to a plurality of decimal digits (e.g. units of seconds, tens of seconds, units of minutes, tens of minutes, etc.) is held in such a way that each decimal digit can be selected, by successive applications of "1" level pulses to the SL terminal, to be incremented by means of successive pulses applied to an ST (Setting) input terminal. Terminal ST of counter 48 is connected to the output o of a waveshaping circuit 109, which is coupled to a timer setting switch 108.

Numeral 64 denotes a display selection circuit, which has a clock input terminal coupled to the output of a waveform shaping circuit 97. The input of waveshaping circuit 97 is coupled to a display changeover switch 96. Successive actuations of switch 96 generates display selection signals, by causing each of three output terminals Tk (timekeeping), Cr (chronograph) and Tm (timer) of display selection circuit 64 to go to the "1" logic level successively.

Numeral 86 denotes a weekdays display control circuit, which comprises a weekdays display changeover circuit 86, a weekdays display decoder circuit 93, and a direction indication counter 84. Direction indication counter 84 receives the clock signal CK2 from frequency divider 42, at a clock input t terminal CL, the output of OR gate 81, at a Count Enable (CE) input terminal, and has a U terminal (up counting control) connected to the CR terminal of stopwatch mode setting switch 98 and a D terminal (down counting control) connected to the TM terminal of timer mode setting switch 100. The count information of direction indication counter 84 is applied to an AND gate 90 in weekdays display changeover circuit 86. It should be noted that, for the sake of simplicity of description, only one weekdays display changeover circuit 86 is shown in FIGS. 4, 4A and 4B. However in practice, a number of such circuit 86 will be provided, since changeover between a plurality of outputs from Direction indication counter 84 and from weekdays counter 40 is performed. Output terminals Cr and Tm of display selection circuit 64 are connected to inputs of an OR gate 91 in weekdays display changeover circuit 86, and the output of OR gate 91 is connected to the other input of AND gate 90. Terminal Tk of display selection circuit 64 is connected to an input of AND gate 88, which receives the output of weekdays counter circuit 40 at its other input terminal. The outputs off AND gates 88 and 90 are connected to inputs of an OR gate 92, the output of which is applied to weekdays display decoder circuit 93. The output signals from weekdays display decoder circuit 93 are applied to display 10.

Output terminals Tk, Cr and Tm of display selection circuit 64 are also connected to inputs of a display changeover circuit 70. As in the case of the weekdays display control circuit 86, display changeover circuit 70 is a representative one of a plurality of display changeover circuits of identical form, which perform changeover between the current time information provided by time counter circuit 31 and the time information from up counter 46 or from down counter 48. A first AND gate 72 in display changeover circuit 70 has one input connected to terminal Tk of display selection circuit 64, and another input connected to receive current time information from time counter 31. A second AND gate 74 is connected to terminal Cr, and another input is connected to the output LO of latch circuit 66. A third AND gate 76 has one input connected to terminal Tm, and another input connected to receive the contents of down counter 48. The outputs of AND gates 72, 74 and 76 are connected to inputs of an OR gate 78, the output of which is applied to the input of digit display decoder circuit 80. Output signals from display decoder 80 are applied to display 10, to provide information display in digital form.

The contents of up counter 46 are applied to an input terminal Li of latch circuit 66. An input terminal La of latch circuit 66 is connected to the Q output terminal of a toggle-type flip-flop 68. The T terminal of FF 68 is connected to the output of a waveshaping circuit 111, which is coupled to a lap switch 110. Latch circuit 66 has the characteristic of passing the signal applied to terminal Li to terminal Lo, without change, if terminal La is at the "0" logic level. When terminal La goes from the "0" level to the "1" level, then the current logic level state of terminal Li at the time of this "0" to "1" level transition of terminal La is latched, to appear thereafter at terminal Lo, until terminal La again goes to the "0" logic level.

The operation of the circuit of FIGS. 4, 4A and 4B in the normal timekeeping mode, stopwatch, and timer mode of operation, will now be described. In the normal timekeeping mode, terminal Tk of display selection circuit 64 is at the "1" logic level. Terminals Cr and Tm are at the "0" logic level. AND gate 88 of weekdays display control circuit 82 is thereby enabled to pass the contents of weekdays counter 40 through OR gate 92 to the weekdays display decoder 93. The output from weekdays display decoder 93 causes one of the display segments 26 to 38 of display 10 to be deactivated, while the other six segments 26 to 38 are activated. Similarly, AND gate 72 in display changeover circuit 70 is enabled to apply the contents of time counter 31 through OR gate 78 to digit display decoder 80. The output signals from digit display decoder 80 thereby cause the current time and date to be displayed by display 10 in digital form, as shown in FIG. 1A.

If display changeover switch 96 is now actuated once, then a pulse is applied to the CL terminal of display selection circuit 64, causing terminal Cr to go to the "1" logic level and terminal Tk to go to the "0" level. AND gate 74 is display changeover circuit 70 is therefore enabled to pass the output of latch circuit 66 through OR gate 78 to digit display decoder 80. If at this time the Q output of FF 68 is at the "0" logic level, then the output from latch circuit 66 will correspond to the contents of up counter 46. At the same time, the output of OR gate 91 in weekdays display changeover circuit 86 goes to the "1" level, so that AND gate 90 is enabled to pass the output of direction indication counter 84 to OR gate 92, and so to weekdays display decoder 93. If the user now actuates zero reset switch 104, then an output pulse from waveshaping circuit 105 is applied to up counter 46, causing the contents of counter 46 to be reset to zero. When the user now actuates switch 98, the CR terminal goes to the "1" level, causing the U terminal of direction indication counter 84 to go to the "1" level from the "0" level. The circuit arrangement of direction indication counter 84 is such that this counter is set in the up counter mode, and is preset to a count of zero, by the "0" level to "1" level transition at terminal U. The appearance of display 10 in this condition is as shown in FIG. 1B. If the user now actuates START/STOP switch 102, then counting up by counter 46 will be enabled, since a "1" level pulse is applied through AND gate 58, causing FF 50 to toggle so that an "1" level input is applied to the CE terminal of counter 46. Counting of time in 1/10 second increments will therefore be displayed by display 10, in digital form. At the same time, since the output of OR gate 81 goes to the "1" level due to the output of FF 50, counting by direction indication counter 84 is enabled, in the up direction. The contents of counter 84, applied through AND gate 90 and OR gate 92 to weekdays display decoder 93, cause weekdays display segments 26 to 38 to be sequentially deactivated, from left to right, in successive cycles. Flashing from left to right across weekdays display 24 therefore appears, to indicate that operation in the stopwatch mode is being performed.

At this time, if lap switch 110 is actuated, then the Q output FF 68 is caused to go to the "1" level. As explained previously, this causes the current contents of up counter 46 at that time, applied to terminal Li, to be latched in latch circuit 66, appearing at terminal Lo. The corresponding lap time therefore appears, in stationary form, on display 10. However, since counting by direction indication counter 84 is not interrupted, flashing from left to right of weekdays display 24 is continued, to notify the user that stopwatch operation is continuing. If lap switch 110 is not actuated once more, then the contents of up counter 46 will again be output from latch circuit 66, so that they are displayed in digital form by display 10. Lap times can thus be displayed whenever required, without affecting the stopwatch counting by up counter 46.

To halt operation in the stopwatch mode, the user actuates start/stop switch 102 once, causing the Q output of FF 50 to go to the "0" logic level.

Operation in the timer mode will now be described. If the timepiece was previously in the stopwatch mode, then the user actuated display changeover switch 96 once, causing output Tm of display selection circuit 64 to go to the "1" level and terminal Cr to return to the "0" level. AND gate 90 thus remains enabled by the output of OR gate 91 AND gate 76 is enabled to pass the output from down counter 48 to OR gate 78, and hence to digit display decoder 80. The user sets switch 98 to the OFF position, and sets timer mode setting switch 100 to the ON position. This causes a "0" to "1" level transition to take place at the D terminal of direction indication counter 84. Counter 84 is thereby set in the down counting mode, and the contents of this counter are preset to a value of six. This causes display segment 38 of weekdays display 24 to be deactivated, so that the appearance of display 10 becomes as shown in FIG. 1C, but with a digital display of zero. The timepiece is now in the timer mode of operation. By successively actuating timer digit selector switch 106, the user can now select any of digits 12, 14 and 16 to be set to a desired value, and can set the selected digits to that desired value by actuating timer setting switch 108 a suitable number of times. A preset time value has now been established, so that display 10 will appear as shown in FIG. 1C, for example.

To initiate operaton in the timer mode, the user actuates start/stop switch 102 once, causing a pulse to be output from waveshaping circuit 103 which is passed through AND gate 60 to toggle FF 52. The Q output of FF 52 therefore goes from the "0" level to the "1" level, so that counting down by down counter 48 in response to clock pulses CK2 is initiated, from the preset initial count value. At the same time, since the "1" level state of the output of FF 52 causes the output of OR gate 81 to go to the "1" level, counting down by direction indication counter 84 begins. As a result, the output signals from weekdays display decoder cause sector 36 to be deactivated and sector 38 to be activated, then sector 34 to be deactivated, and so on, so that flashing of the segments 26 to 38 of weekdays display 24 from right to left, cyclically repeated, is caused to occur.

When the contents of down counter 48 reach a value of zero, the the "0" output terminal of down counter 48 goes to the "1" logic level, thereby causing the output of AND gate 56, and hence the output of OR gate 62, to go to the "1" level. FF 52 is thereby toggled, so that its Q output goes to the "0" level, thereby inhibiting further counting of clock pulses CK2 by counter 48.

To return to the normal timekeeping mode of operation from this condition, the user sets the timer mode setting switch 100 to the OFF state, and actuates display changeover switch 96 once, causing a pulse to be applied to the C1 terminal of display selection circuit 64, so that terminal Tk of display selection circuit 64 goes to the "1" level, while terminals Cr and Tm are at the "0" level. The appearance of the display is now once more as shown in FIG. 1A.

Figures 5, 5A:
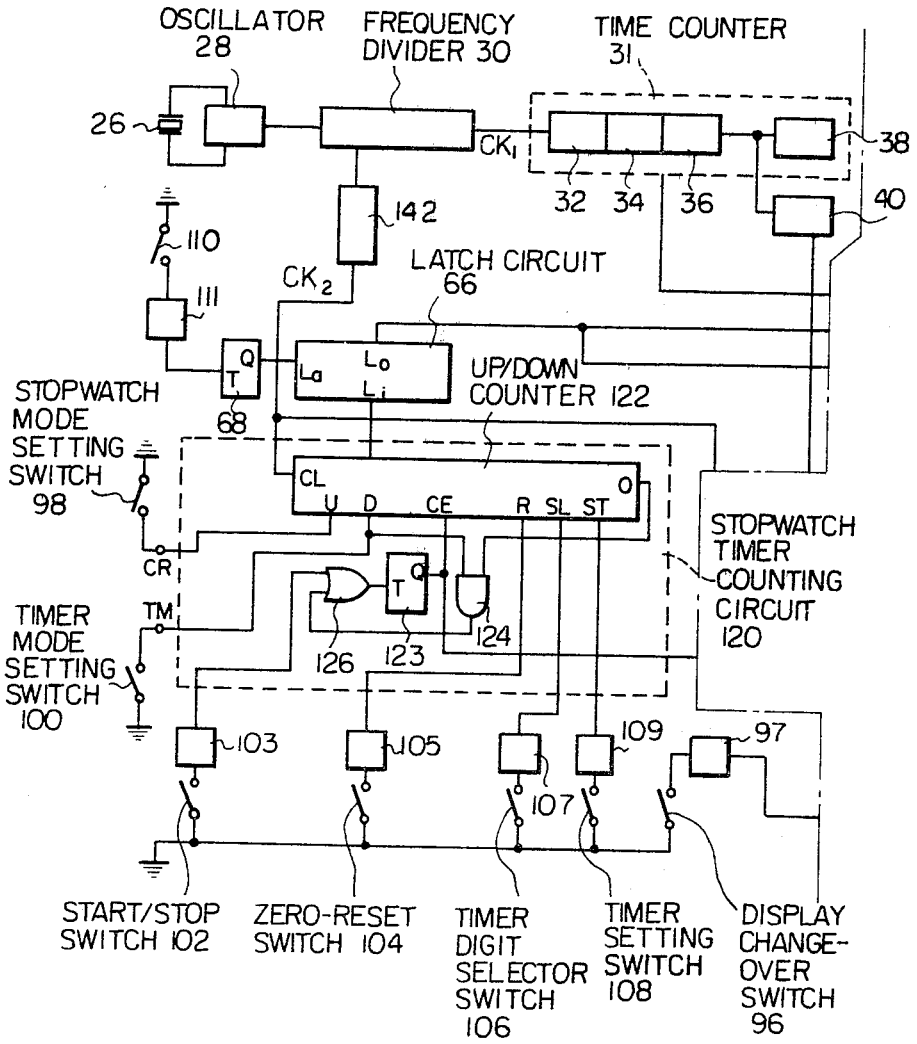
FIG. 5 is a block diagram showing the relationship between FIGS. 5A & 5B.
FIG. 5A and 5B are each part of a second example of a circuit diagram for an electronic timepiece according to the present invention.
Figure 5B:
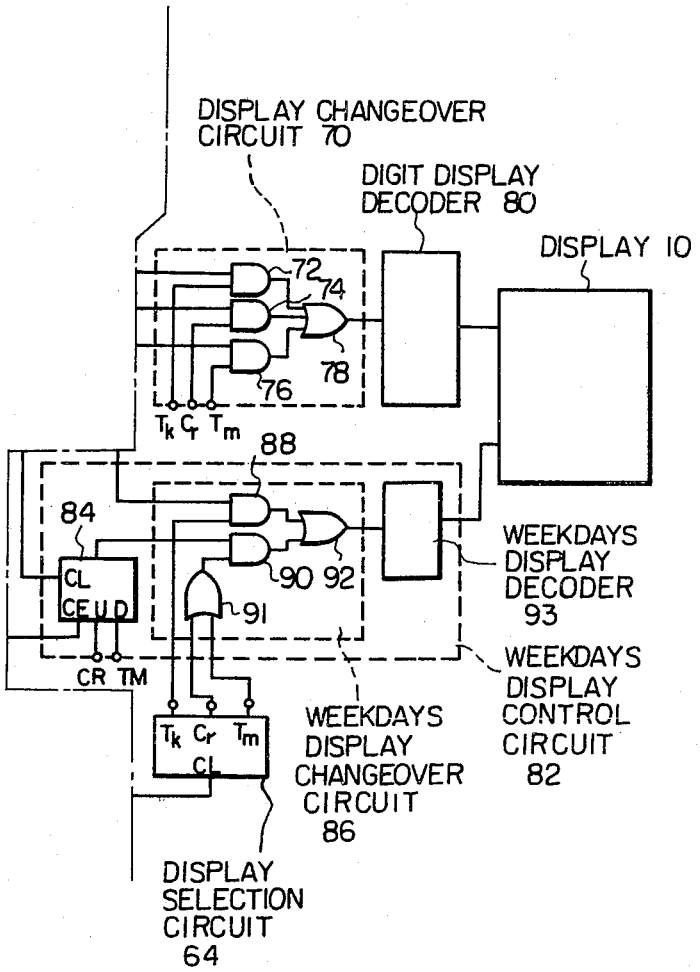

Referring now to FIGS. 5, 5A, 5B and 5C a second embodiment of an electronic timepiece according to the present invention is shown. The circuit of FIGS. 5A, 5B and 5C is essentially similar to that of FIGS. 4, 4A and 4B but has been simplified by replacing up counter 46 and down counter 48 by a single up/down counter or reversible counter circuit 122. Up/down counter 122 receives clock pulses CK2 at a CL input terminal, and has a U terminal coupled to terminal CR os stopwatch mode setting switch 98. When terminal U is at the "1" level, the counting up by counter 122 is possible. A terminal D is connected to the TM terminal of time mode setting switch 100, and to an input of an AND gate 124. When terminal D is at the "1" level, then counting down by counter 122 is possible. A reset terminal R is coupled to the output of waveshaping circuit 105 of zero reset switch 104. Terminals CE, SL and ST perform the same functions as in the case of down counter 46 of the embodiment of FIG.4 described above. However when terminal CE goes to the "1" level, then counting in either the up direction or in the down direction is initiated, depending upon whether terminal U or D is at the "1" level.

The output of waveshaping circuit 103 of start/stop switch 102 is connected to an input of an OR gate 126, the output of which is connected to the T terminal of a toggle-type flip-flop 123. The Q output of FF 123 is connected to the CE terminal of up/down counter 122, and also to the CE terminal of direciton indication counter 84. The "0" output terminal of counter 122 is connected to a second input of AND gate 124, and the output of AND gate 124 is connected to another input of OR gate 126. The output of waveshaping circuit 107 is connected to the SL (digit selection) terminal of counter 122, while waveshaping circuit 109 output is connected to the ST (digit setting) terminal of counter 122.

The operation of the circuit of FIGS. 5A, 5B and 5C is identical to that of the circuit of FIGS. 4, 4A and 4B in the normal timekeeping mode, and so will not be described. The operation in the stopwatch mode is as follows. The timer mode setting switch 100 is set to the OFF position, and the stopwatch mode setting switch 98 is set to the ON position. Terminal CR thereby goes to the "1" logic level, so that counting up by counter 122 is designated. If zero reset switch 104 is actuated in this condition, then the display 10 will appear as shown in FIG. 1B, as the contents of up/down counter 122 are reset to zero. Stopwatch operation can now be initiated by actuating start/stop switch 102, as in the case of the first embodiment described above.

The operation of the circuit of FIGS. 5A, 5B and 5C in the timer mode of operation is as follows. The user sets stop watch mode setting switch 98 to the OFF state, and timer mode setting switch 100 to the ON state, so that a "1" level signal is applied to the D terminal of up/down counter 122, and to an input of AND gate 124. By actuating display changeover switch 96, and selecting and setting a desired preset time value by actuating timer digit selection switch 106 and timer setting switch 108, a desired time can be set in up/down counter 122, and display 10 will then appear as shown in FIG. 1C. Actuation of start/stop switch 102 then causes an output pulse to be applied from OR gate 126 to FF 123, so that counting down from the preset time value is initiated by the Q output of FF 123 going to the "1" logic level. When the count in up/down counter 122 reaches zero, output "0" of counter 122 goes to the "1" level, so that the output of AND gate 124, and hence the output of OR gate 126 goes to the "1" level. FF 123 is thereby again toggled, so that output Q returns to the "0" logic level, and further counting by up/down counter 122 is inhibited. At this time also, since the CE terminal of direction indication counter 84 goes to the "0" level, flashing from right to left of weekdays display section 24 is halted.

Figure 6:
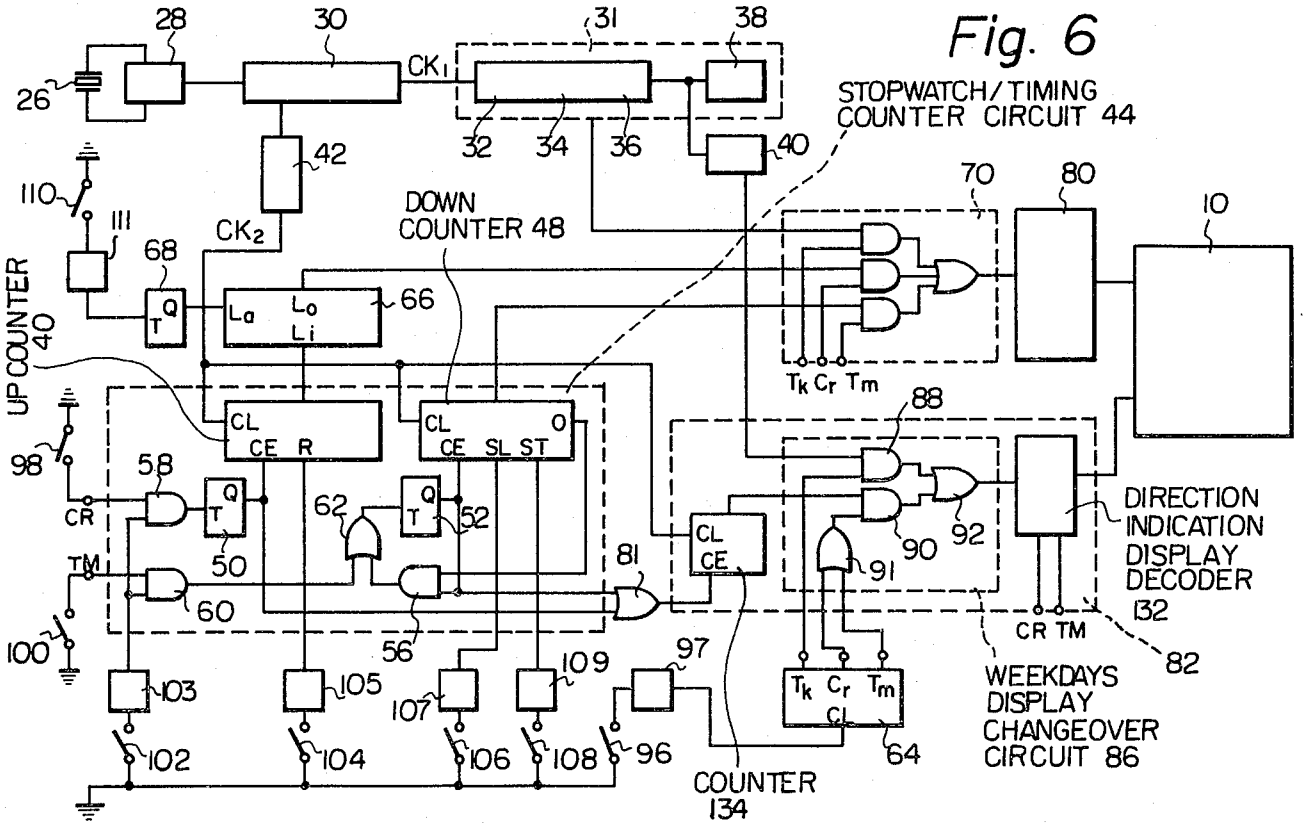
FIG. 6 is a third example of a circuit diagram for an electronic timepiece according to the present invention.

Referring now to FIG. 6, a block diagram of a third embodiment of the present invention is shown. As in the case of FIGS. 5A, 5B and 5C circuit blocks and components having the same reference numerals as those of FIG. 4, described above, have the same functions and operation as the corresponding components and blocks in FIGS. 4, 4A and 4B. The circuit of FIG. 6 is identical to that of FIGS. 4, 4A and 4B except for circuit blocks 134 and 132 in the weekdays display control circuit 82 in the embodiment of FIG. 6. Circuit block 134 is a binary counter, which counts in one direction, and which replaces the direction indication counter 84, (an up/down counter). Circuit block 132 is a direction indication display decoder circuit, controlled by signals applied to terminals CR and TM from stopwatch mode setting switch 98 and timer mode setting switch 100. Decoder circuit 132 functions such that, when terminal CR is at the H level and counting by counter 134 is enabled by an "1" level signal applied to the CE terminal of counter 134, segments 26 to 38 of display 10 are successively and cyclically deactivated in the direction from left to right, i.e. direction A in FIG. 1B. When terminal TM is at the "1" level and terminal CR is at the "0" level, on the other hand, display segments 26 to 38 are successively and cyclically deactivated in the right-to-left direction, i.e. direction B in FIG. 1C.

Figure 7:
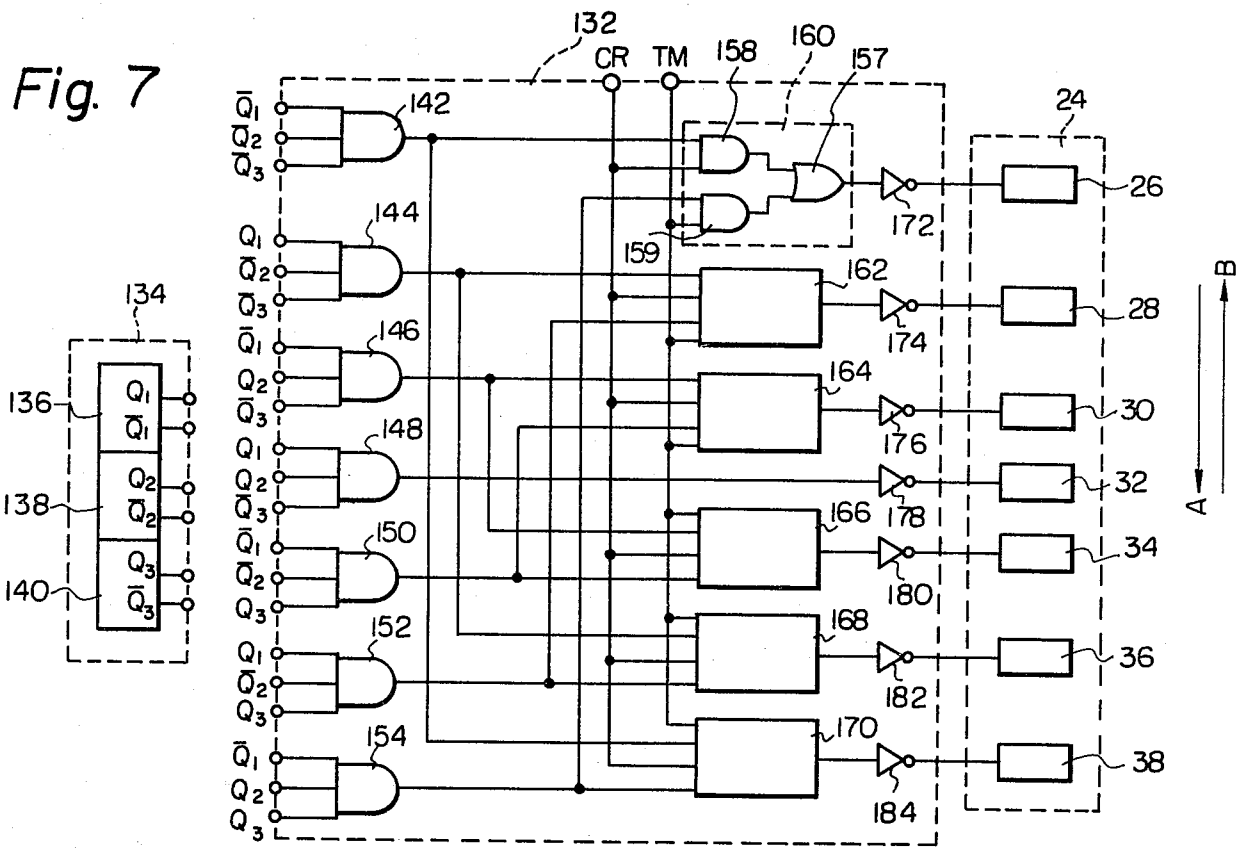
FIG. 7 is a circuit diagram of a weekdays display decoder/driver circuit in the circuit of FIG. 6.

The operation of decoder circuit 132 will beexplained with reference to the circuit diagram, which is shown in FIG. 7. In FIG. 7, reference numerals 136, 138 and 140 indicate three flip-flops which constitute counter circuit 134, and whose outputs are Q1 and $\overline{Q1}$, Q2 and $\overline{Q2}$, Q3 and $\overline{Q3}$. The count of counter 134 is decoded by means of a set of AND gates 142 to 154, which receive combinations of the outputs of counter 134 to produce output signals corresponding to 7 count states of counter 134. The output signals from AND gates 142 to 154 are applied to a set of gate circuit blocks 160 to 170, which are controlled by signals on terminals CR and TM, and which serve as direction changeover circuits. The circuit components of a representative one of direction changeover circuits, 160, are indicated, and comprise two AND gates 158 and 159, and an OR gate 157. The output from AND gate 142, which indicates a count in counter 134 of zero, is applied to an input of AND gate 158, while terminal CR is connected to the other input of AND gate 158. The output of AND gate 154, which goes to the "1" level on a count of six in counter 134, is connected to an input of AND gate 159 in gate block 160. The outputs of AND gates 158 and 159 are connected to inputs of OR gate 157, the output of which is connected to the input of an inverter 172. A drive voltage applied to display segment 26 is at the zero level when the output of OR gate 157 is at the "1" logic level, and goes to a sufficiently high level to activate display segment 24 when the output of OR gate 157 goes to the "0" logic level. Thus, if the timepiece is in the stopwatch mode of operation, so that terminal CR is at the "1" logic level, then when the count of counter 134 is zero, the output of AND gate 158 will be at the "1" level, so that display segment 24 will be unactivated, since the output from inverter 172 will be at zero volts. If, on the other hand, the timepiece is in the timer mode of operaton, then terminal TM will be at the "1" logic level, so that AND gate 159 is enabled. In this case, when the count of counter 134 is zero, the outputs of both of AND gates 158 and 159 in direction changeover circuit 160 will be at the "0" logic level. The output of inverter 172 will therefore be at the high level, so that display segment 24 will be activated. However the output of an AND gate (not shown) in direction changeover circuit 170, which receives the output of AND gate 142 and is also connected to terminal TM, will be at the "1" logic level at this time. Thus, the output of inverter 184 will be at the zero level, so that display segment 38 will be deactivated. Thus, when there is a count of zero in counter 134, display segment 26 will be unactivated and all of the other segments 28 to 38 will be activated, if the timepiece is in the stopwatch mode of operation. If the timepiece is in the timer mode of operation, however, then display segment 38 will be unactivated, while the remaining segments 26 to 36 will be activated. Similarly, in the stopwatch mode, display segments 28, 30, 32, 34, 36 and 38 will be deactivated successively when counter 134 is in count states 1, 2, 3, 4, 5 and 6 respectively. In the timer mode, display segments 36, 34, 32, 30, 28 and 26 will be deactivated successively, when counter 134 is in count states 1, 2, 3, 4, 5 and 6, respectively. Flashing of the segments of weekdays display 24 from left to right (i.e. in the direction of arrow A) will therefore take place when in the stopwatch mode of operation. Flashing of the segments of weekdays display 24 from right to left (i.e. in the direction of arrow B) will take place during the timer mode of operation, as shown in FIG. 1C.

Figure 8:
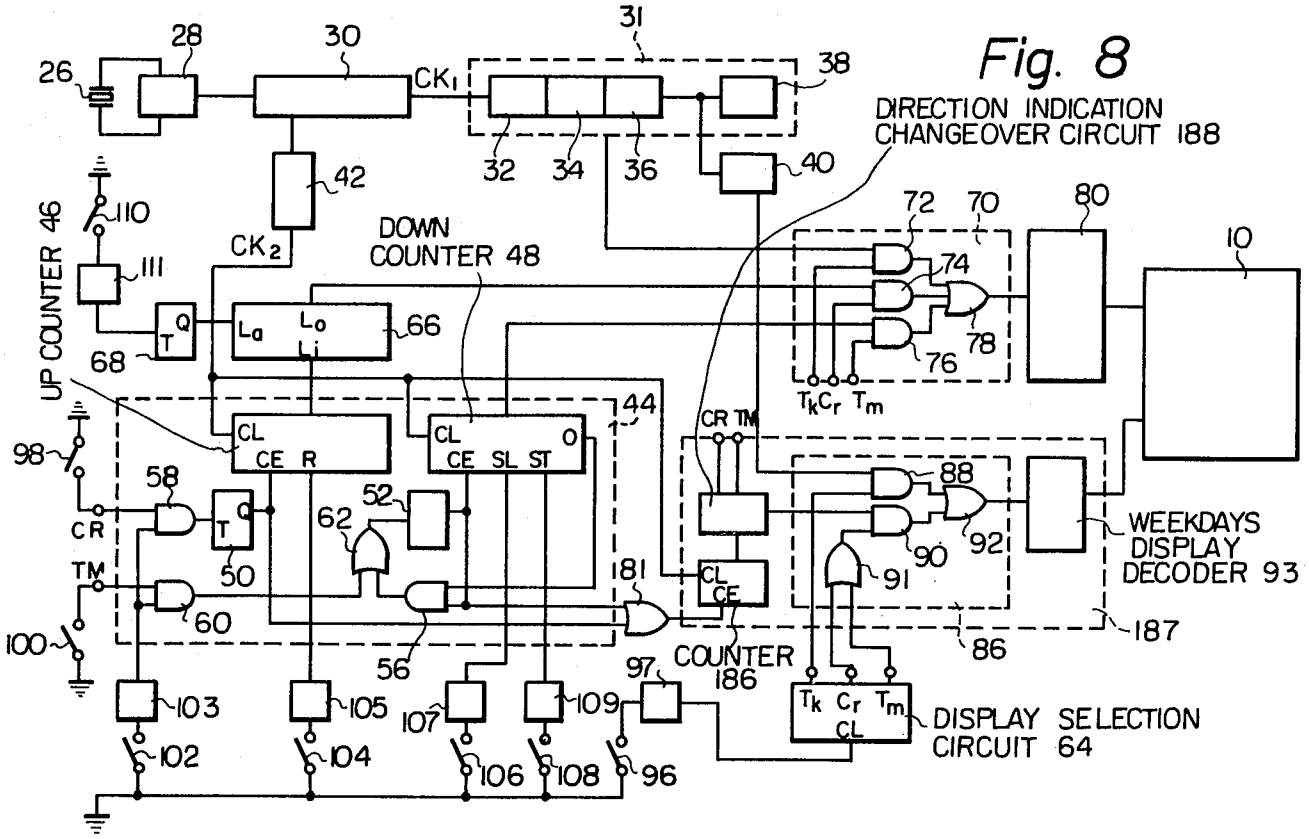
FIG. 8 is a fourth example of a circuit diagram for an electronic timepiece according to the present invention.

FIG. 8 shows a fourth embodiment of the present invention, in block diagram form. This embodiment is similar to that of FIGS. 4, 4A and 4B described above, but utilizes an ordinary binary counter 186 as the direction indication counter, in conjunction with a direction indication changeover circuit 188. Changeover circuit 188 is controlled by the logic levels applied to terminals CR and TM, so that the condition in which the Q and $\overline{Q}$ outputs of counter 186 are applied to decoder 93 when terminal TM is at the "1" level are inverted with respect to the state in which the outputs of counter 186 are applied when terminal CR is at the "1" logic level. Thus, same type of control of the output signals from decoder 93 is achieved as by the direction indication counter 84 of the circuit of FIGS. 4, 4A and 4B and flashing from left to right across weeks display section 24 occurs in the stopwatch operating mode, while flashing from right to left occurs when in the timer operating mode.

Figure 9:
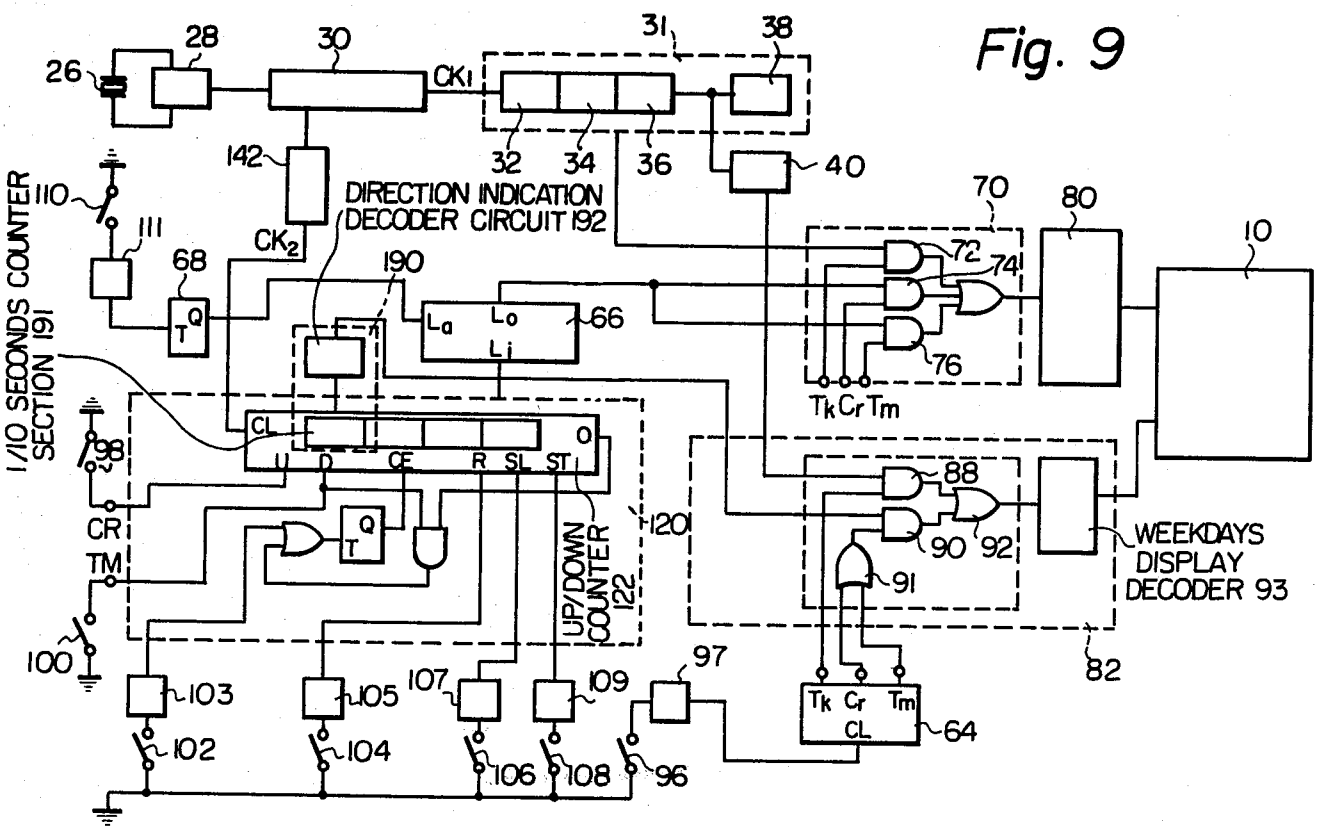
FIG. 9 is a fifth example of a circuit diagram for an electronic timepiece according to the present invention.

FIG. 9 shows a fifth embodiment of the present invention, in block diagram circuit form. This embodiment is similar to that of FIGS. 5A, 5B and 5C, utilizing an up/down counter circuit 122. However, in the fifth embodiment, up/down counter circuit 122 includes a counter section 191 which counts tenths of seconds. Counter section 191 is used both for providing the tenths of seconds information which is displayed digitally in the stopwatch mode and for performing the functions of a direction indication counter, such as counter 84 in the circuit of FIGS. 4, 4A and 4B. A direction indication decoder circuit 192 is coupled between counter section 191 and weekdays display control circuit 82, and serves to convert the output signals from counter section 191, which are in binary coded decimal form, into suitable form for applying to weekdays display decoder 93. Tenths of seconds counter section 191 in conjunction with auxiliary decoder 192 therefore perform the same function as direction indication counter 84 in the circuit of FIGS. 4, 4A and 4B.

In the embodiments of the present invention described above, single display segments of the weekdays display section 24 are successively and cyclically deactivated, in order to indicate the stopwatch and timer modes of operation. However, it is equally possible to successively deactivate two or more display segments at a time, to provide the desired mode indications.

Also, although shifting of the deactivated segment of weekdays display 24 is performed at a frequency of 10 Hz in the described embodiments, it is equally possible to perform this shifting at some other suitable frequency.

Furthermore, although in the described embodiments a segment of weekdays display section 24 is sequentially deactivated while other segments are activated, it is equally possible to utilize the opposite arrangement, in which one or more segments at a time is sequentially activated, while other segments are unactivated.

Thus, although the present invention has been shown and described with reference to specific embodiments, various changes and modifications to those embodimentss are possible, which come within the scope claimed for the present invention.

What is claimed is:

1. An electronic timepiece, comprising:

a source of a standard high frequency signal;

frequency divider means responsive to said standard frequency signal for producing a standard time signal and a train of clock pulses;

first counter circuit means responsive to said standard time signal for counting at least the hours and minutes of current time;

external actuation means for selectively generating first and second control signals;

second counter circuit means for receiving said train of clock pulses, being responsive to said first control signal for counting said clock pulses in an upward direction and responsive to said second control signal for counting said clock pulses in a downward direction;

direction indication drive signal generation means responsive to said first control signal for generating a first display drive signal and responsive to said second control signal for generating a second display drive signal;

digit display decoder means coupled to receive said first and second counter circuit contents and to thereby produce digit display drive signals; and opto-electronic display means comprising a digit display pattern and an array of linearly arranged display segments, being responsive to said digit display drive signals for displaying the contents of said first and second counter circuits in digital form by said digit display pattern, and furthermore responsive to said first display drive signal for successively and cyclically activating and deactivating said linearly arranged display segments in a first direction, and responsive to said second display drive signal for successively and cyclically activating and deactivating said linearly arranged display segments in a second direction.

2. An electronic timepiece according to claim 1, wherein said direction indication drive signal generation means comprises:

a direction indication counter comprising a reversible counter circuit responsive to said first control signal for counting said clock pulses in an up direction and responsive to said second control signal for counting said clock pulses in a down direction; and display decoder means coupled to receive the count contents of said reversible counter circuit, for producing said first display drive signal when said reversible counter ciruit is counting in the up direction and for producing said second display drive signal when said reversible counter circuit is counting in the down direction.

3. An electronic timepiece according to claim 1, wherein said direction indication drive signal generation means comprises:

a counter circuit for counting said clock pulses;

decoder cirucuit means for decoding the contents of said counter circuit to produce a plurality of count indication signals;

direction changeover circuit means for receiving said count indication signals, being responsive to said first control signal for applying a signal corresponding to each of said count indication signals to corresponding ones of said linearly arranged display segments, in a first order of arrangement, and responsive to said second control signal for applying a signal corresponding to each of said count indication signals to corresponding ones of said linearly arranged display segments in a second order of arrangement, said first and second orders of arrangement being mutually opposite.

4. An electronic timepiece according to claim 3, wherein said decoder circuit means comprises a plurality of gate circuits coupled to combinations of output signals from said unidirectional counter circuit, and wherein said direction changeover circuit means comprises a plurality of changeover circuit blocks, each of said blocks comprising a first gate circuit for receiving a first one of said count indication signals and controlled by said first control signal, second gate circuit for receiving a second one of said count indication signals and controlled by said second control signal, and gate means for combining output signals produced by said first and second gate circuits.

5. An electronic timepiece according to claim 1, wherein said direction indication drive signal generation means comprises:

counter circuit means for counting said clock pulses;

output changeover circuit means for receiving the contents of said counter circuit means and responsive to said first control signal for outputting said counter circuit contents without change, and furthermore responsive to said second control signal for outputting the logical inverse of said counter circuit contents; and decoding circuit means for receiving the output signals from said output changeover circuit, and for producing said first display drive signals when said counter circuit contents are output from said output changeover circuit without change and for producing said second display drive signals when said counter circuit contents are output by said output changeover circuit in logically inverted form.

6. An electronic timepiece according to claim 1, wherein said direction indication drive signal generation means comprises:

a section of said second counter circuit means; and decoder circuit means coupled to receive the contents of said section of said second counter circuit means for producing said first display drive signals when said second counter circuit is counting in the up direction and for producing said second display drive signals when said second counter circuit is counting in the down direction.

7. An electronic timepiece according to claim 1, wherein said first counter circuit means further comprises a weekdays counter circuit for counting the days of the week.

8. An electronic timepiece according to claim 7, wherein said direction indication drive signal generation means comprises:

direction indication counter circuit means;

weekdays display changeover circuit means for receiving the count contents of said weekdays counter circuit and of said direction indication counter circuit; and weekdays display decoder circuit means for receiving output signals from said weekdays display changeover circuit means, and for thereby producing said first and second display drive signals and for further producing a weekdays display drive signal.

9. An electronic timepiece according to claim 8, further comprising display selection circuit means, and externally actuated display changeover switch means for producing control signals applied to said display selection circuit to selectively cause said display selection circuit means to produce first and second display selection signals, said first and second display selection signals being applied to said weekdays changeover circuit to cause said weekdays counter contents and said direction indication counter contents respectively to be applied to said weekdays display decoder circuit.

10. An electronic timepiece according to claim 9, wherein said first and second display selection signals are applied to said display changeover circuit, to thereby cause the hours and minutes of time contents of said first counter circuit and the contents of said second counter circuit respectively to be applied to said digit display decoder circuit.

11. An electronic timepiece according to claim 1, wherein said second counter circuit comprises an up counter circuit and a down counter circuit.

12. An electronic timepiece according to claim 1, wherein said second counter circuit comprises a reversible counter circuit.

13. An electronic timepiece according to claim 1, wherein said second counter circuit further comprises a first control terminal for enabling and disenabling counting, a second control terminal for resetting the counter contents to zero, a third control terminal for selecting portions of said second counter circuit contents corresponding to decimal digits, and a fourth control terminal for setting said selected portion of said second counter contents to a desiredvalue, and further comprising externally actuated counter control switch means coupled to said first control terminal, zero-reset switch means coupled to said second control terminal, digit selector switch means coupled to said third control terminal, and setting switch means coupled to said fourth control terminal.

14. An electronic timepiece, comprising:

a source of a standard high frequency signal;

frequency divider means responsive to said high frequency signal for producing a standard time signal and a train of clock pulses;

time counter circuit means comprising seconds, minutes, hours, date and weekday counter circuits for providing current time information in response to said standard time signal;

reversible counter circuit means having a clock input terminal coupled to receive said train of clock pulses, and further comprising a first control terminal for designating an up mode of counting, a second control terminal for designating a down mode of counting, a third control terminal for initiating counting in said up and down modes, a fourth control terminal for resetting the counter contents to zero, a fifth control terminal for selecting portions of said counter circuit contents corresponding to decimal digits, a sixth control terminal for setting said selected portion of said counter contents to a desired value, and a zero count indication terminal for producing a signal indicating a count of zero;

an externally actuated stopwatch mode setting switch coupled to said first control terminal;

an externally actuated counter control switch;

an externally actuated zero reset switch coupled to said fourth control terminal;

an externally actuated timer mode setting switch coupled to said second control terminal;

an externally acutated timer digit selection switch coupled to said fifth control terminal;

an externally actuated timer setting switch coupled to said sixth control terminal;

a first gate circuit having inputs coupled to said zero count indication terminal and to said timer mode setting switch;

a second gate circuit having inputs coupled to said counter control switch and to the output of said first gate circuit;

a toggle-type flip-flop circuit havng a toggle terminal coupled to the output of said second gate circuit and an output coupled to said third control terminal;

a latch circuit coupled to receive the contents of said reversible counter;

an externally operated lap switch couple to a control terminal of said latch circuit;

a display changeover circuit coupled to receive the seconds, minutes and hours contents of said time counter from the output of said latch circuit;

a digit display decoder circuit coupled to the output of said display changeover circuit;

an electro-optical display coupled to the output of said digit display decoder circuit;

a direction indication counter circuit for counting said clock pulses, having a count enable terminal coupled to said output of said toggle-type flip-flop and having a first control terminal for designating counting in the up direction, coupled to said stopwatch mode setting switch, and having a second control terminal for designating counting in the down direction, coupled to said timer setting switch;

a weekdays display changeover circuit coupled to receive the contents of said weekdays counter circuit of said time counter circuit means and to receive the contents of said direction indication counter circuit;

a weekdays display decoder circuit coupled to receive the output of said weekdays display changeover circuit;

an externally actuated display changeover switch;

a display selection circuit responsive to signals produced by successive actuations of said display changeover switch for successively producing first, second and third display selection signals being applied to said display changeover circuit and to said weekdays display changeover circuit, said first display selection signal causing said display changeover circuit to transfer contents of said time counter circuit representing hours, minutes and seconds of current time information to said digit display decoder and causing said weekdays display changeover circuit to transfer the contents of said weekdays counter to said weekdays display decoder, said second and third display selection signals causing said display changeover circuit to transfer the output from said latch circuit to said digit display decoder and causing said weekdays display changeover circuit to transfer the contents of said direction indication counter circuit to said weekdays display decoder circuit; and opto-electronic display means coupled to output terminals of said digit display decoder circuit and said weekdays display decoder circuit, comprising a digit display pattern and an array of linearly arranged display segments, said display means being responsive to output signals from said digit display decoder circuit for displaying the hours, minutes and seconds of current time in digital form and for displaying the count contents of said reversible counter in digital form, and being further responsive to output signals from said weekdays display decoder circuit for indicating the day of the week by deactivating one of said linearly arranged display segments and for selectively indicating the up counting mode of operation of said reversible counter by sequentially and cyclically activating and deactivating said linearly arranged display segments in a first direction and indicating the down counting mode of operation of said reversible counter by sequentially and cyclically activating and deactivating said linearly arranged display segments in a second direction.

* * * * *